US011236945B2

(12) United States Patent
Bauer et al.

(10) Patent No.: US 11,236,945 B2
(45) Date of Patent: Feb. 1, 2022

(54) CONTROLLABLE LIQUID DISTRIBUTOR OF A COILED-TUBE HEAT EXCHANGER FOR REALIZING DIFFERENT LIQUID LOADINGS

(71) Applicant: Linde Aktiengesellschaft, Munich (DE)

(72) Inventors: Heinz Bauer, Ebenhausen (DE); Florian Deichsel, Munich (DE); Marcus Lang, Zell (DE); Juergen Spreemann, Rosenheim (DE); Manfred Steinbauer, Raisting (DE)

(73) Assignee: LINDE AKTIENGESELLSCHAFT, Munich (DE)

( * ) Notice: Subject to any disclaimer, the term of this patent is extended or adjusted under 35 U.S.C. 154(b) by 124 days.

(21) Appl. No.: 16/834,029

(22) Filed: Mar. 30, 2020

(65) Prior Publication Data

US 2020/0318912 A1 Oct. 8, 2020

(30) Foreign Application Priority Data

Apr. 2, 2019 (EP) ..... 19020246

(51) Int. Cl.
*F28D 3/04* (2006.01)
*F28D 3/02* (2006.01)

(52) U.S. Cl.
CPC ..... *F28D 3/04* (2013.01); *F28D 3/02* (2013.01)

(58) Field of Classification Search
CPC ..... F28D 3/00; F28D 3/02; F28D 3/04; F28D 5/02; F28D 7/024; F28F 25/02; F28F 27/02; F28F 9/026; F28F 25/04; F28F 25/06; F28F 25/085; F25J 2290/32; F25B 39/028
See application file for complete search history.

(56) References Cited

U.S. PATENT DOCUMENTS 2,737,789 A * 3/1956 Ruff ..... F28D 5/02 62/305
3,256,932 A * 6/1966 Schlichting ..... F28D 7/024 165/163
3,395,676 A * 8/1968 Sprague ..... F22B 1/063 122/32
3,666,423 A * 5/1972 Muenger ..... B01J 8/0285 422/200
3,997,635 A * 12/1976 Hallgren ..... F28F 25/02 261/161
4,124,069 A * 11/1978 Becker ..... F28D 9/04 165/164

(Continued)

*Primary Examiner* — Jianying C Atkisson
*Assistant Examiner* — Jose O Class-Quinones
(74) *Attorney, Agent, or Firm* — Millen White Zelano & Branigan, PC; Brion P. Heaney

(57) ABSTRACT

A heat exchanger includes a core tube extending in a shell space, several tubes wound around the core tube, and a liquid distributor. The liquid distributor is arranged above the tubes in the shell space and applies a liquid phase of a first medium to the tubes. The liquid distributor has distributor arms projecting in the radial direction from the core tube, an annular channel extending above the distributor arms in a circumferential direction of the shell and a collector tank formed by the core tube. The annular channel and the collector tank are each designed to collect the first medium. The distributor arms form at least one first container and at least one second container separated from the first container.

14 Claims, 4 Drawing Sheets

(56) References Cited

Figure 1:
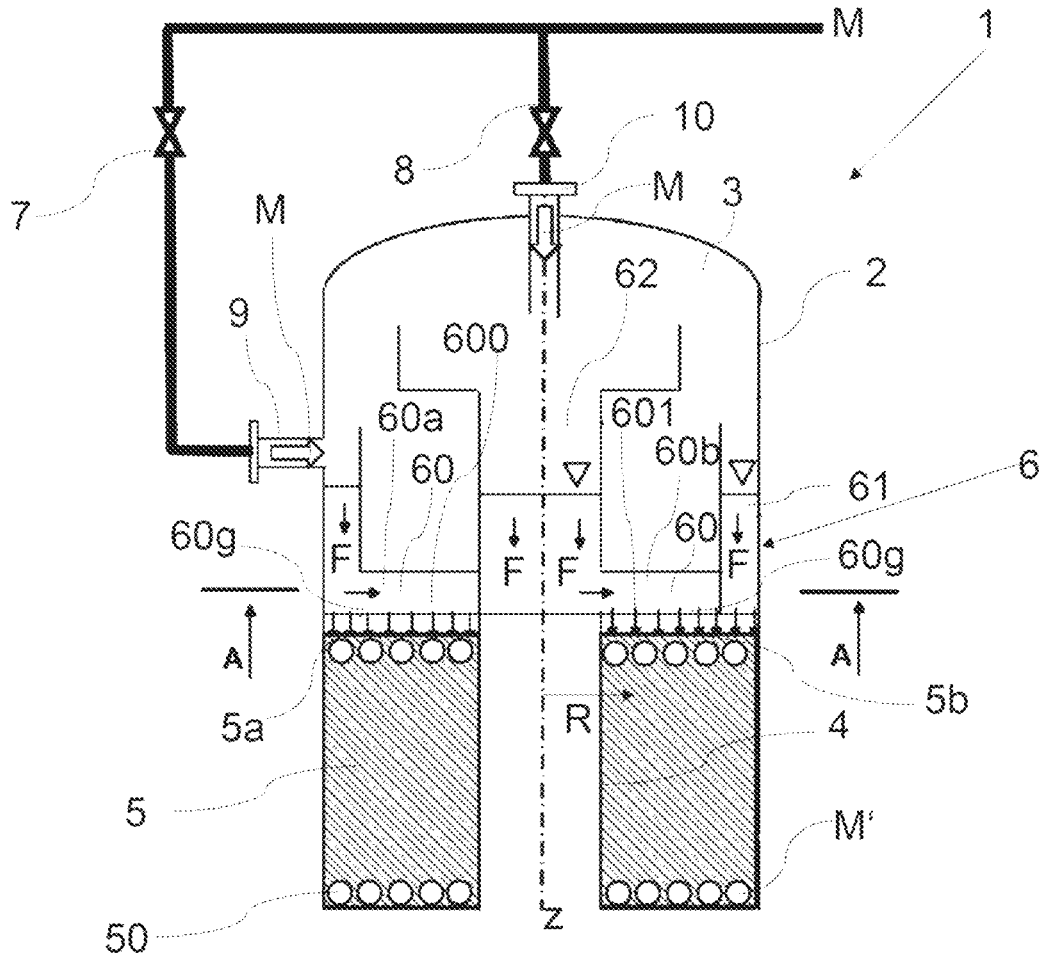

U.S. PATENT DOCUMENTS 4,201,262 A * 5/1980 Goldstein ..... F28D 3/04 165/117
4,359,448 A * 11/1982 Schuurman ..... B01J 8/1836 422/143
4,557,877 A * 12/1985 Hofstetter ..... B01D 3/008 239/450
4,565,216 A * 1/1986 Meier ..... B01D 3/008 137/561 A
5,181,537 A * 1/1993 Powers ..... F24H 9/124 137/561 A
5,501,079 A * 3/1996 Kreis ..... B01D 3/008 62/643
5,832,994 A * 11/1998 Nomura ..... F28D 7/005 165/173
8,087,454 B2 * 1/2012 Kerber ..... F25J 5/002 165/115
8,118,284 B2 * 2/2012 Alzner ..... B01D 53/185 261/97
9,273,913 B2 * 3/2016 Steinbauer ..... F28F 9/026
9,726,434 B2 * 8/2017 Steinbauer ..... F28D 7/0066
9,746,260 B2 * 8/2017 Steinbauer ..... F28F 27/02
9,766,024 B2 * 9/2017 Fersti ..... F28D 9/0068
10,113,802 B2 * 10/2018 Steinbauer ..... F28F 9/026
2005/0077029 A1 * 4/2005 Morales Cervantes ..... F28D 7/103 165/90
2008/0115918 A1 * 5/2008 Kerber ..... F28D 7/024 165/165
2008/0271983 A1 * 11/2008 Alzner ..... B01D 3/20 202/158
2012/0160453 A1 * 6/2012 Alzner ..... F25J 3/0295 165/104.13
2012/0261088 A1 * 10/2012 Steinbauer ..... F28D 7/024 165/11.1
2012/0261089 A1 * 10/2012 Steinbauer ..... F28D 7/0066 165/11.1
2012/0261103 A1 * 10/2012 Steinbauer ..... F28D 7/024 165/163
2013/0113128 A1 * 5/2013 Alzner ..... B01D 3/22 261/158
2015/0000873 A1 * 1/2015 Steinbauer ..... F25J 5/002 165/104.21
2015/0369548 A1 * 12/2015 Fersti ..... F25J 5/002 165/296
2016/0209118 A1 * 7/2016 Roberts ..... F28D 7/024
2018/0245844 A1 * 8/2018 Spreemann ..... F28D 7/024
2018/0245856 A1 * 8/2018 Spreemann ..... F28D 7/024
2019/0011191 A1 * 1/2019 Steinbauer ..... F28D 7/024
2019/0063843 A1 * 2/2019 Steinbauer ..... F28F 25/02
2019/0078842 A1 * 3/2019 Steinbauer ..... F28D 7/024

* cited by examiner

CONTROLLABLE LIQUID DISTRIBUTOR OF A COILED-TUBE HEAT EXCHANGER FOR REALIZING DIFFERENT LIQUID LOADINGS

CROSS-REFERENCE TO RELATED APPLICATIONS

This application claims the benefit of European Patent Application No. 19020246.5 filed Apr. 2, 2019, the disclosure of which is herein incorporated by reference in its entirety.

The invention relates to a heat exchanger and to a method for operating such a heat exchanger.

Coiled-tube heat exchangers are used, for example, in natural-gas liquefaction plants. Here, a first fluid medium, which evaporates by means of a falling film, is introduced as refrigerant on the shell side. In this evaporation, a so-called maldistribution through the tube bundle can occur so that some tubes get too much, and other tubes too little, refrigerant. In order to counteract this effect, the tube side, for example, i.e., the media guided in the tube bundle, can be regulated in order to there achieve a distribution of the media, which counteracts a shell-side maldistribution of the first medium or of the refrigerant. Alternatively, the first medium or the refrigerant can also be regulated on the shell side in order to compensate for a maldistribution.

When realizing a controllable liquid distributor, it is necessary to be able to apply different quantities of refrigerant to different regions of the tube bundle.

In this regard, it has been found that valves arranged in the shell space or on the tube bundle as well as movable parts in the interior of the heat exchanger can only be implemented with comparatively great effort.

The object on which the present invention is based is therefore to specify a heat exchanger and a corresponding method for indirect heat transfer, which allows a displacement, in particular a continuous displacement, of the surface-related task of the first medium in a radial direction of the tube bundle, while keeping the outlay for additional instrumentation as low as possible.

This object is achieved by a heat exchanger having the features of claim 1 and by a method having the features of claim 14.

Advantageous developments of these aspects of the invention are specified in the respective dependent claims and are described below.

According to claim 1, a heat exchanger is disclosed, comprising:

a shell surrounding a shell space of the heat exchanger, wherein the shell space is designed to receive a fluid first medium, a core tube extending in the shell space, a tube bundle having several tubes wound around the core tube, wherein the tube bundle is designed to receive at least one fluid second medium so that heat can be transferred indirectly between the first medium and the at least one second medium, and a liquid distributor, arranged above the tube bundle in the shell space, for applying a liquid phase of the first medium to the tube bundle, wherein the liquid distributor has distributor arms projecting in the radial direction from the core tube, an annular channel extending above the distributor arms in a circumferential direction of the shell, and a collector tank formed by the core tube, wherein the annular channel and the collector tank are each designed to collect the first medium.

According to the invention, the distributor arms for applying the liquid phase of the first medium to the tube bundle have at least one first container and at least one second container separated from the first container, wherein the first container is in flow connection with the annular channel so that the liquid phase of the first medium can be introduced from the annular channel into the at least one first container and from there be distributed over a first region of the tube bundle via outlet openings of the first container, and wherein the at least one second container is in flow connection with the collector tank so that the liquid phase of the first medium can be introduced into the at least one second container from the collector tank and from there be distributed over a second region of the tube bundle via outlet openings of the second container.

The distributor arms can each be shaped like a circle segment. Furthermore, two distributor arms adjacent in the circumferential direction of the shell or of the core tube can respectively be separated by a gap through which tubes of the tube bundle can be guided (e.g., to nozzles provided on the shell).

According to one embodiment of the invention, the heat exchanger has at least one first controllable valve, via which the annular channel can be charged with the first medium, and/or the heat exchanger has at least one second controllable valve, via which the collector tank of the core tube can be charged with the first medium.

Furthermore, according to one embodiment of the invention, the annular channel is in flow connection with a first inlet arranged on the shell so that the first medium can be introduced into the annular channel via the first inlet, wherein the first valve, in particular, is arranged upstream of the first inlet.

Furthermore, according to one embodiment, the collector tank of the core tube is in flow connection with a second inlet arranged on the shell so that the first medium can be introduced into the collector tank via the second inlet, wherein the second valve, in particular, is arranged upstream of the second inlet.

Furthermore, according to one embodiment of the invention, the first container and the second container can in each case be simultaneously loaded with variable mass flows of the first medium by corresponding adjustment of the valves.

In a preferred embodiment of the invention, it is furthermore provided that the first container and the second container be arranged above the tube bundle in such a way that the quantity of the liquid phase applied to the tube bundle per unit area and time can be changed or adjusted in a radial direction of the tube bundle by an adjustment of the two valves.

In this way, a displacement, in particular, a continuous displacement, of the surface-related task of the liquid phase of the first medium (e.g., refrigerant) in the radial direction of the tube bundle can be achieved in a simple manner, while advantageously keeping the outlay for additional instrumentation comparatively low.

In order to efficiently adjust the distribution of the liquid phase in the radial direction by means of the containers, according to one embodiment of the invention, the arrangement of the outlet openings of the first and second containers is designed such that radially different amounts of liquid can be adjusted. For example, the second container may have outlet openings located further inward in the radial direction than the outlet openings of the first container. Accordingly, the second container may, for example, only have outlet openings for an inner half of the tube bundle, while the first container only has outlet openings for the outer half of the tube bundle.

In particular, due to the arrangement of the containers above the tube bundle and to a corresponding adjustment of the valves, the said quantity can be changed or adjusted in the radial direction of the tube bundle in such a way that the said quantity, in a radial direction of the tube bundle, increases monotonically outward or decreases monotonically outward.

Furthermore, according to one embodiment of the invention, the at least one first container is formed by a first distributor arm of the liquid distributor, and the at least one second container is formed by a second distributor arm of the liquid distributor.

Furthermore, according to an alternative embodiment of the invention, the at least one first container is formed by a first region of a distributor arm, and the at least one second container is formed by a second region of the distributor arm separated from the first region.

According to one embodiment, it is provided in this respect that the two regions run next to each other in the radial direction along which the distributor arm extends. In this case, according to one embodiment, it can furthermore be provided that the two regions be separated from each other in terms of flow by a partition wall, extending in the radial direction, of the distributor arm.

According to an alternative embodiment, it can furthermore be provided that the two regions lie opposite each other in the radial direction along which the distributor arm extends. In this respect, according to one embodiment, it may furthermore be provided that the two regions be separated from each other by a partition wall extending in a circumferential direction of the core tube.

A further aspect of the present invention relates to a method for performing indirect heat transfer between at least one first fluid medium and a second fluid medium using a heat exchanger according to the invention, wherein the second medium is introduced into the tube bundle, and wherein a first mass flow of the first medium is introduced into the at least one first container via the annular channel, and wherein (in particular, at the same time) a second mass flow of the first medium is introduced into the at least one second container via the collector tank, wherein the two mass flows (e.g., using the said valves) are adjusted in order to change or adjust the quantity of the liquid phase of the first medium being applied per unit area and time to the tube bundle via the outlet openings of the at least one first container and the outlet openings of the at least one second container in the radial direction of the tube bundle.

According to one embodiment of the method, the two mass flows of the first medium are here adjusted in such a way that the said quantity of the liquid phase of the first medium, in a radial direction of the tube bundle, increases monotonically outward or decreases monotonically outward.

Figure 2:
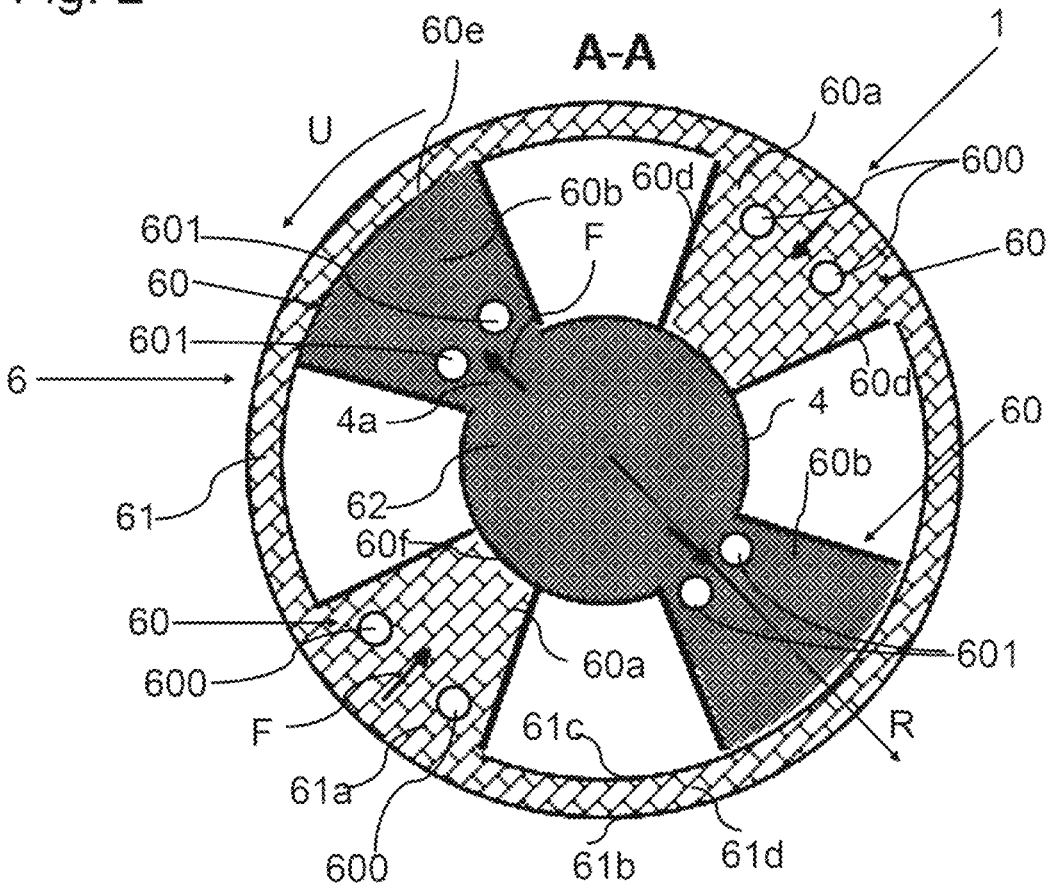
Figure 3:
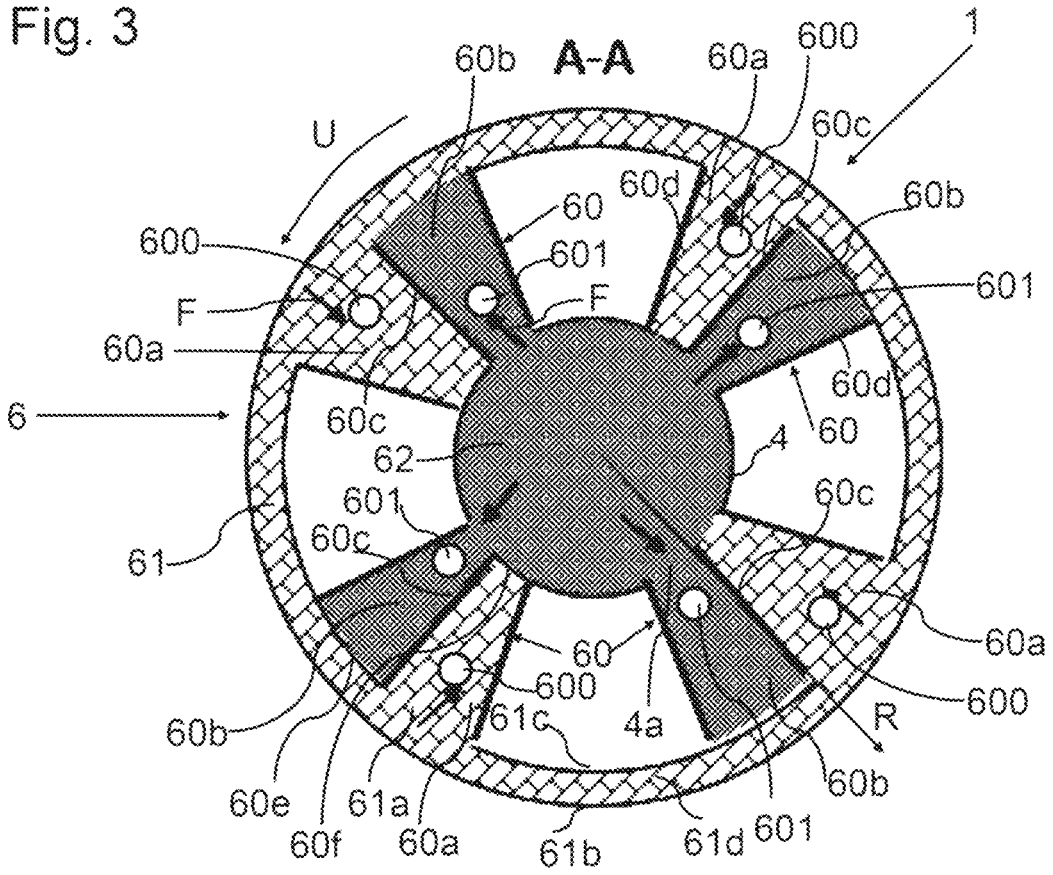
Figure 4:
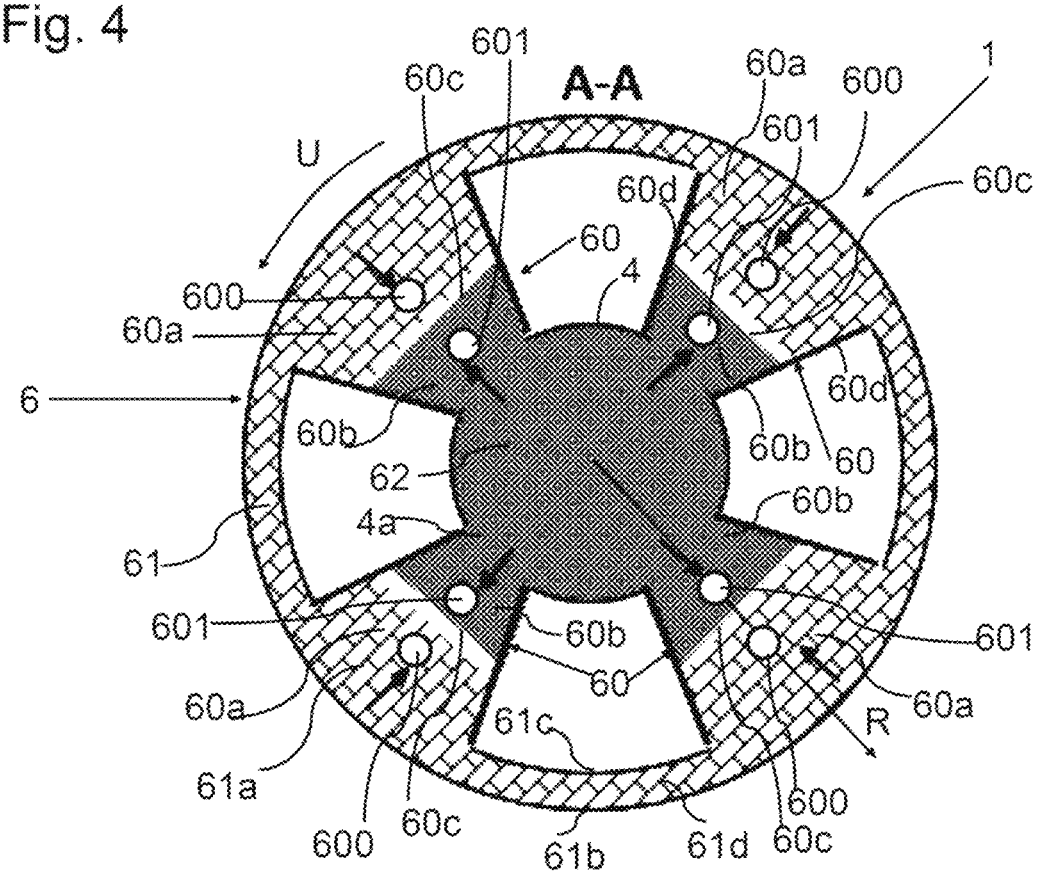

Embodiments of the invention and other features and advantages of the invention are explained below with reference to the figures. Shown are:

FIG. 1 a schematic sectional view of an embodiment of a heat exchanger according to the invention;

FIG. 2 a schematic sectional view along plane A-A of FIG. 1;

FIG. 3 a schematic sectional view of another embodiment of the invention; and FIG. 4 a schematic sectional view of another embodiment of the invention.

FIG. 1 shows, in connection with FIG. 2, an embodiment of a heat exchanger 1 according to the invention, which makes it possible to counteract a maldistribution of a first medium M (for example, a refrigerant), guided within a shell space 3, onto a tube bundle 5 of the heat exchanger 1.

For this purpose, the heat exchanger 1, in detail, has a shell 2 which surrounds the shell space 3, a core tube 4 which extends within the shell space 3 and onto which the tubes 50 of the tube bundle 5 are wound, wherein the tube bundle 5 is designed to receive at least one fluid second medium M' so that heat can be transferred indirectly between the first medium M and the at least one second medium M'. In the manufacture of the heat exchanger 1, the core tube 4 serves in particular as a core or carrier of the tube bundle, wherein the individual tubes 50 are wound onto the horizontally arranged core tube 4 with interpositioning of spacers. During operation of the heat exchanger 1, the core tube 4 extends along the vertical axis and preferably supports at least one part of the load of the tubes 50 of the tube bundle 5. The individual tubes 50 are preferably wound helically onto or around the core tube 4, at least in sections. Such a heat exchanger is therefore also referred to as a coiled-tube heat exchanger 1.

Furthermore, the heat exchanger 1 has, in relation to the vertical axis or to the longitudinal axis z of the core tube 4, a liquid distributor 6, arranged above the tube bundle 5 within the shell space 3, for applying to the tube bundle 5 a liquid phase F of the first medium M, wherein the liquid distributor 6 has distributor arms 60 which project from the core tube 3 in the radial direction R and which, for example in plan view along the longitudinal axis z, can be designed in the shape of a circle segment (cf. also FIGS. 2 through 4). The distributor arms 60 each have a bottom 60*g*, as well as side walls 60*d* rising from the bottom 60*g* and extending from the core tube 4 outward to the annular channel 61.

Furthermore, the liquid distributor 6 preferably has an annular channel 61 extending or going around above the distributor arms 60 in a circumferential direction U of the shell 2, as well as a collector tank 62 formed by the core tube 4, wherein the annular channel 61 and the collector tank 62 are each designed to collect the first medium M, which is, in particular, a two-phase mixture. The first medium M can be calmed and degassed in the collector tank 62 and in the annular channel 61 or, subsequently, in the containers 60*a*, 60*b* or regions 60*a*, 60*b* so that a liquid phase F of the first medium or refrigerant M can ultimately be distributed over the tube bundle 5 via the distributor arms 60.

As can be seen from FIGS. 1 and 2, it is provided that the distributor arms 60 form at least one first container 60*a* and at least one second container 60*b* separated from the first container 60*a*, wherein the at least one first container 60*a* is in flow connection with the annular channel 61 so that the liquid phase F of the first medium M can be introduced from the annular channel 61 into the at least one first container 60*a* and from there be distributed over a first region 5*a* of the tube bundle 5 via outlet openings 600 of a bottom 60*g* of the at least one first container 60*a*, and wherein the at least one second container 60*b* is in flow connection with the collector tank 62 so that the liquid phase F of the first medium M can be introduced into the at least one second container 60*b* from the collector tank 62 and from there be distributed over a second region 5*b* of the tube bundle 5 via outlet openings 601 of a bottom 60*g* of the at least one second container 60*b*.

As can be seen in particular with reference to FIG. 2, it can be provided that the liquid distributor 6 have several (here, for example, four) distributor arms 60, wherein two distributor arms 60 opposite each other in the radial direction R each form a first container 60*a* which is fluidically separated from the collector tank 62 or the core tube 4 (e.g., by a wall section 60*f* of the core tube 4) and is fed with the liquid phase F of the first medium M only from outside via the annular channel 61, e.g., through an opening 61*a* of an inner wall 61*c* of the annular channel 61. As can be seen from FIG. 2, the inner wall 61*c* lies opposite an outer circumferential wall 61*b* of the annular channel 61, wherein both walls rise from a bottom 61*d* of the annular channel 61. The annular channel 61 can also be attached to the shell 2 so that, for example, the outer wall 61*b* can be formed by the shell 2.

Furthermore, two further distributor arms 60, which lie opposite each other in the radial direction R, each form a second container 60*b*, wherein the respective second container 60*b*, in contrast to the respective first container 60*a*, is separated fluidically from the annular channel 61 (for example, by a section 60*e* of the inner wall 61*c* of the annular channel 61) and is fed from the inside with the liquid phase of the F of the first medium M only via the collector tank 62 or the core tube 4. For this purpose, a wall of the core tube 4 can in each case have a corresponding opening 4*a*. The containers 60*a*, 60*b* are each assigned to a region 5*a* or 5*b* of the upper side of the tube bundle 5 (cf. FIG. 1) so that the distribution of the liquid phase F onto the tube bundle 5 can be influenced by differences in liquid delivery to the regions 5*a*, 5*b*.

In order to influence the distribution of the liquid phase F, it can, for example, be provided that the first and second containers 60*a*, 60*b* permit different liquid states and thus also different flow rates. Furthermore, the arrangement of the outlet openings 600, 601 of the first and second containers 60*a*, 60*b* can be designed in such a way that radially different amounts of liquid can be adjusted. For example, the second containers 60*b* connected to the core tube 4 may have outlet openings 601 located further inward in the radial direction R than the outlet openings 600 of the first containers 60*a*. For example, the second containers 60*b* may thus have only outlet openings 601 for an inner half of the tube bundle 5, and the first containers 60*a* connected to the annular channel 61 may have only outlet openings 600 for the outer half of the tube bundle 5. In this case, the outlet openings 600, 601 may also vary in size, or an overlap of the outlet openings 600 of the first containers 60*a* with the outlet openings 601 of the second containers 60*b* with respect to the radial direction may be provided.

As FIG. 1 furthermore shows, it is preferably provided that the annular channel 61 can be charged with the first medium M via a first valve 7 and via the subsequent first inlet or nozzle 9 so that a corresponding mass flow of the first medium M into the annular channel 61 and first containers or distributor arms 60*a* can be controlled accordingly. Furthermore, it is provided that the collector tank 62 can be charged with the first medium M via a second valve 8 and also via the subsequent second inlet or nozzle 10, which is provided on the shell 2 centrally above the collector tank 62, so that a corresponding mass flow of the first medium M into the collector tank 62 or second containers or distributor arms 60*b* can likewise be controlled accordingly.

By correspondingly adjusting the valves 7, 8 or regulating the two mass flows of the first medium M, the quantity of liquid phase F which is applied along the radial direction R of the tube bundle 5 to the tube bundle 5 or to the regions 5*a*, 5*b* can now be varied in order to counteract a maldistribution of the liquid phase F in the shell space 3.

In the exemplary embodiment according to FIG. 2, the distributor arms 60 are thus fed from the outside via the annular channel 61 (first container 60*a*) or from the inside via the collector tank 62 (second container 60*b*) provided in the core tube 4 in order to, if necessary, vary or adjust the liquid delivery to the tube bundle 5 in the radial direction R.

In contrast, FIG. 3 shows an alternative embodiment of the liquid distributor 6, wherein the at least one first container 60*a* is formed by a first region 60*a* of a distributor arm 60, and wherein the at least one second container 60*b* is formed by a second region 60*b* of the same distributor arm 60 separated fluidically from the first region 60*a*. In this case, it is preferably provided according to FIG. 3 that the two regions 60*a*, 60*b* extend side by side from the core tube 4 to the shell 2 in the radial direction R along which the distributor arm 60 extends, wherein the two regions 60*a*, 60*b* are preferably separated from each other by a partition wall 60*c*, extending in the radial direction R, of the distributor arm 60. Here, the first region 60*a* is in turn supplied from the outside with the liquid phase F of the first medium M via the annular channel 61, and, specifically, via an opening 61*a* in the inner wall 61*c* of the annular channel 61. Furthermore, the first region 60*a* is, for example, fluidically separated from the core tube 4 or collector tank 62 by a wall section 60*f* of the core tube 4.

In contrast, the at least one second region 60*b* is supplied with the liquid phase F of the first medium M from the collector tank 62 via an opening 4*a* of the core tube 4 and is fluidically separated from the annular channel 61 by, for example, a section 60*e* of the inner wall 61*c* of the annular channel 61.

In particular, according to FIG. 3, all (e.g., four) distributor arms 60 are divided in this manner into separate first and second regions 60*a*, 60*b*.

In FIG. 3 as well, the annular channel 61 is variably supplied with the liquid phase F via the first valve 7, whereas the collector tank 62 is variably supplied with the liquid phase F of the first medium M via the second valve 8.

By correspondingly adjusting the valves 7, 8 or regulating the two mass flows of the first medium M into the annular channel 61 or into the collector tank, the quantity of liquid phase F which is applied along the radial direction R of the tube bundle 5 to the tube bundle 5 or to the regions 5*a*, 5*b* can now be varied in order to counteract a maldistribution of the liquid phase F in the shell space 3.

In this case, it is again provided according to one embodiment that the outlet openings 600, 601 of the first and second containers 60*a*, 60*b* be designed in such a way that radially different amounts of liquid can be adjusted. For example, the second containers 60*b* connected to the core tube 4 may have outlet openings 601 located further inward in the radial direction R than the outlet openings 600 of the first containers 60*a*. For example, the second containers 60*b* may have only outlet openings 601 for an inner half of the tube bundle 5, and the first containers 60*a* connected to the annular channel 61 may have only outlet openings 600 for the outer half of the tube bundle 5 (see above).

FIG. 4 shows a further variant of a heat exchanger 1 according to the invention, wherein, here again, the at least one first and the at least one second region 60*a*, 60*b* are formed by a distributor arm, wherein, in contrast to FIG. 3, the partition wall 60*c*, which fluidically separates the two regions 60*a*, 60*b*, extends in the circumferential direction U of the shell 2 or of the core tube 4 so that the two regions 60*a*, 60*c* lie opposite each other in the radial direction R along which the distributor arm extends from the core tube to the shell 2. Here, the first region is supplied with the liquid phase F via, for example, an opening 61*a* of the inner wall 61*c* of the annular channel, whereas the second region 60*b* is supplied with the liquid phase F from the collector tank 62 via, for example, an opening 4*a* of the core tube 4. In this case, the outlet openings 600 of the first containers 60*a* lie further outward in the radial direction R than the outlet openings 601 of the second containers 60*b*.

In particular, according to FIG. 4, once again, all (e.g., four) distributor arms 60 are divided in this manner into separate first and second regions 60*a*, 60*b*.

As already mentioned previously, the annular channel 61 according to FIG. 4 is variably supplied with the liquid phase F via the first valve 7, whereas the collector tank 62 is variably supplied with the liquid phase F of the first medium M via the second valve 8.

By correspondingly adjusting the valves 7, 8 or regulating the two mass flows of the first medium M into the annular channel 61 or into the collector tank 62, the quantity of liquid phase F which is applied along the radial direction R of the tube bundle 5 to the tube bundle 5 or to the regions 5*a*, 5*b* can now be varied in order to counteract a maldistribution of the liquid phase F in the shell space 3. For example, if the mass flow of the first medium M is increased into the collector tank 62 or is reduced into the annular channel 61, more liquid F will be transferred to the tube bundle 5 via the inner second regions 60*b* than via the outer first regions 60*a*.

Thanks to the liquid distributor according to the invention, it is possible to optimally react to any influence on the part of the process and counteract a maldistribution on the part of the shell so that the performance of the heat exchanger is improved overall.

The two regions 60*a*, 60*b* can also be realized by means of a split annular channel 61 (e.g., two semicircular annular channels or two concentric annular channels) or a split core tube 4 (e.g., a nested, concentric core tube or a core tube with a divided diameter). The distributor arms 60 can also have any other spatial separation. Furthermore, more than two valves or containers can also be used for adjusting the liquid distribution in the radial direction of the tube bundle.

The invention claimed is:

1. A heat exchanger, comprising:

a shell surrounding a shell space of the heat exchanger, wherein the shell space is designed to receive a fluid first medium, a core tube extending in the shell space, a tube bundle having several tubes wound around the core tube, wherein the tube bundle is designed to receive at least one fluid second medium so that heat can be transferred indirectly between the first medium and the at least one second medium, a liquid distributor, arranged above the tube bundle in the shell space, for applying to the tube bundle a liquid phase of the first medium, wherein the liquid distributor has distributor arms projecting in the radial direction from the core tube; an annular channel extending above the distributor arms in a circumferential direction of the shell, as well as a collector tank formed by the core tube, wherein the annular channel and the collector tank are each designed to collect the first medium, wherein the distributor arms for applying the liquid phase of the first medium to the tube bundle form at least one first container and at least one second container separate from the first container, wherein the at least one first container is in flow connection with the annular channel so that the liquid phase of the first medium can be introduced from the annular channel into the at least one first container and from there, via outlet openings of the at least one first container, be distributed over a first region of the tube bundle, and wherein the at least one second container is in flow connection with the collector tank so that the liquid phase of the first medium can be introduced from the collector tank into the at least one second container and from there can be distributed over a second region of the tube bundle via outlet openings of the at least one second container.

2. The heat exchanger according to claim 1, wherein the heat exchanger has a first valve via which the annular channel can be charged with the first medium and/or the heat exchanger has a second valve via which the collector tank of the core tube can be charged with the first medium.

3. The heat exchanger according to claim 2, wherein the annular channel is in flow connection with a first inlet arranged on the shell so that the first medium can be introduced into the annular channel via the first inlet, wherein the first valve is arranged upstream of the first inlet.

4. The heat exchanger according to claim 2, wherein the collector tank of the core tube is in flow connection with a second inlet arranged on the shell so that the first medium can be introduced into the collector tank via the second inlet, wherein the second valve is arranged upstream of the second inlet.

5. The heat exchanger according to claim 2, wherein the at least one first container and the at least one second container are arranged above the tube bundle in such a way that the quantity of the liquid phase of the first medium applied to the tube bundle per unit area and time can be changed in a radial direction of the tube bundle by an adjustment of the two valves.

6. The heat exchanger according to claim 2, wherein the at least one first container and the at least one second container can be simultaneously charged in each case with variable mass flows of the first medium by corresponding adjustment of the valves.

7. The heat exchanger according to claim 1, wherein the at least one first container is formed by a first distributor arm of the liquid distributor and that the at least one second container is formed by a second distributor arm of the liquid distributor.

8. The heat exchanger according to claim 1, wherein the at least one first container is formed by a first region of a distributor arm of the liquid distributor and the at least one second container is formed by a second region of the distributor arm that is separated from the first region.

9. The heat exchanger according to claim 8, wherein the two regions run next to each other in the radial direction along which the distributor arm extends.

10. The heat exchanger according to claim 8, wherein the two regions are separated from each other by a partition wall, extending in the radial direction, of the distributor arm.

11. The heat exchanger according to claim 8, wherein that the two regions lie opposite each other in the radial direction along which the distributor arm extends.

12. The heat exchanger according to claim 8, wherein the two regions are separated from each other by a partition wall extending in a circumferential direction of the core tube.

13. The heat exchanger according to claim 1, wherein one or more of the outlet openings of the at least one first container are located further outward in the radial direction of the tube bundle than the outlet openings of the at least one second container, or one or more of the outlet openings of the at least one second container lie further outward in the radial direction of the tube bundle than the outlet openings of the at least one first container.

14. A method for effecting an indirect heat transfer between at least one first fluid medium and one second fluid medium using a heat exchanger according to claim 1, wherein the second medium is introduced into the tube bundle, and wherein a first mass flow of the first medium is introduced into the at least one first container via the annular channel, and wherein a second mass flow of the first medium is introduced into the at least one second container via the collector tank, wherein the two mass flows are adjusted in order to change, in a radial direction of the tube bundle, the quantity of the liquid phase of the first medium being applied per unit area and time to the tube bundle via the outlet openings of the at least one first container and of the at least one second container.

* * * * *